US006325899B1

(12) United States Patent
DeWent

(10) Patent No.: US 6,325,899 B1
(45) Date of Patent: Dec. 4, 2001

(54) DISPOSABLE AND RECYCLABLE INTERMEDIATES FOR USE IN ELECTROSTATIC COATING PROCESSES

(75) Inventor: Charles DeWent, El Cajon, CA (US)

(73) Assignee: Action Caps, LLC, San Diego, CA (US)

( * ) Notice: Subject to any disclaimer, the term of this patent is extended or adjusted under 35 U.S.C. 154(b) by 0 days.

(21) Appl. No.: 09/522,784

(22) Filed: Mar. 10, 2000

(51) Int. Cl.[7] ..... B05C 11/11; B05D 1/04; H05F 3/00

(52) U.S. Cl. ..... 204/164; 118/500; 118/504; 427/458; 427/471

(58) Field of Search ..... 422/186.06; 204/297 W, 204/662, 471, 164; 118/500, 504; 427/458, 471

(56) References Cited

U.S. PATENT DOCUMENTS

| | | | | |
|---|---|---|---|---|
| 2,730,988 | * | 1/1956 | Starkey | 118/638 |
| 3,509,036 | | 4/1970 | Igras et al. . | |
| 3,575,832 | | 4/1971 | Johnson . | |
| 3,777,875 | | 12/1973 | Sobran . | |
| 3,785,952 | | 1/1974 | Ritzenhoff . | |
| 4,069,790 | * | 1/1978 | Witte | 118/70 |
| 4,088,559 | | 5/1978 | Sandmeier et al. . | |
| 4,097,359 | | 6/1978 | Davitz . | |
| 4,217,853 | | 8/1980 | Davitz . | |
| 4,243,146 | | 1/1981 | Davitz . | |
| 4,421,627 | | 12/1983 | LeBaron . | |
| 4,628,859 | | 12/1986 | Hines . | |
| 4,668,358 | | 5/1987 | Ball . | |
| 4,682,562 | | 7/1987 | Hell . | |
| 4,988,426 | | 1/1991 | Metzka . | |
| 5,081,952 | * | 1/1992 | Grassi et al. | 118/500 |
| 5,119,140 | | 6/1992 | Berkes et al. . | |
| 5,133,161 | | 7/1992 | Reas . | |
| 5,524,774 | | 6/1996 | Cullen . | |
| 5,551,552 | | 9/1996 | Ophardt et al. . | |
| 5,617,800 | | 4/1997 | Moreschi et al. . | |
| 5,753,042 | * | 5/1998 | Bauer | 118/504 |
| 5,897,709 | | 4/1999 | Torefors . | |
| 5,908,120 | | 6/1999 | Yates et al. . | |
| 5,930,471 | | 7/1999 | Milewski et al. . | |
| 6,036,779 | | 3/2000 | Tolbert . | |
| 6,040,037 | * | 3/2000 | Imai | 428/209 |

FOREIGN PATENT DOCUMENTS

| | | | |
|---|---|---|---|
| 36 31 747 A | * | 3/1988 | (DE) . |
| 36 31 747 A1 | | 3/1988 | (DE) . |
| 91 06 199 U | * | 7/1991 | (DE) . |
| 91 06 199 | | 8/1991 | (DE) . |
| 295 07 807 | * | 8/1995 | (DE) . |
| 295 07 807 U1 | | 9/1995 | (DE) . |
| 0 933 140 A | * | 8/1999 | (EP) . |
| 0 933 140 A1 | | 8/1999 | (EP) . |
| 909 915 | | 11/1962 | (GB) . |
| 909 915 A | * | 11/1962 | (GB) . |
| 56062565 | * | 8/1981 | (JP) . |
| 04190864 | * | 7/1992 | (JP) . |
| 04 190864 A | | 7/1992 | (JP) . |

* cited by examiner

*Primary Examiner*—Kathryn Gorgos
*Assistant Examiner*—Thao Tran
(74) *Attorney, Agent, or Firm*—Brown, Martin, Haller & McClain, LLP

(57) ABSTRACT

The invention relates to a new component for protecting hangers associated with electrostatic coating processes. The component is electrically conductive and inexpensive relative to the hanger which it serves to protect. The component lessens the cost associated with traditional hanger cleaning and preserves hanger life and integrity.

16 Claims, 2 Drawing Sheets

DISPOSABLE AND RECYCLABLE INTERMEDIATES FOR USE IN ELECTROSTATIC COATING PROCESSES

BACKGROUND OF THE INVENTION

Electrostatic coating processes rely on a charge differential between an article to be coated and what is used to coat that article. In such processes, the article is typically grounded whereas the coating to be applied is endowed with a charge. When the article and coating are then brought into contact with one another, the result is that the coating adheres to the article. It is estimated that more than 10,000 facilities for accomplishing this exist in the U.S. alone.

Most such coating procedures and facilities employ a variety of steps, i.e., a cleaning step, a drying step, a coating step, and a heating step wherein the adhered coating is cured to afford a more desirable and permanent coat. These steps usually take place sequentially using batch operations commonly employed in the art, or else in specialized stations connected by a continuous conveyor line.

Conveyor lines can be of varying length depending on the facility. Articles to be coated are hung from these lines via spaced electroconductive racks or hangers that serve to ground articles attached thereto. Racks and hangers are popular that have the capacity to hang multiple articles. This is accomplished by multiple hooks, usually spot welded at set distances from one another on the same rack. Such rack and hook configurations vary widely in shape, size, and configuration to support different types and sizes of articles.

Once attached, the hangers or racks bearing grounded articles are conveyed through a coating station followed by a curing station. Once coating and curing are finished, the coated objects are removed and the process begins anew.

The hangers and racks of such systems, being expensive, are typically re-used. After passing through the coating station a number of times, that portion or portions of the hanger which contact the article gradually becomes fouled by the coating. The net effect is interference with grounding capacity, with consequent poor coating of the article, and an eventual possibility for spark or fire. This necessitates periodic replacing or cleaning of the racks or hangers, i.e., hooks, which is both time-consuming and expensive.

In the case of cleaning for re-use, conventional cleaning methods include chemical stripping, molten bath stripping, burning, and mechanical stripping, i.e., sandblasting, hammering, and filing. These processes reduce the useful life and capacity of racks, hangers, and hooks by compromising their structural integrity over time. For example, it is the Applicant's experience that hooks break off fairly regularly, thereby lessening the capacity and desirability of continuing with that rack. This necessitates, at considerable expense, either repair of the old rack or replacement with a new rack.

The art has thus far failed to provide a cost-effective alternative.

SUMMARY OF THE INVENTION

The invention provides a surprisingly efficient solution to the long-felt need described above.

It is an object of the invention to provide an electrically conductive intermediate, preferably a pliable one, at an interface or contact point between the hanger and article to be coated. This intermediate may be conveniently replaced or recycled at a comparatively small cost relative to existing procedures and implements.

In a first aspect, the invention features a system for extending the operating life of hangers or racks associated with electrostatic coating. This is accomplished by use of a relatively cheap, electrically conductive, and preferably pliable, intermediate that is suitable for grounding an article to be coated. The intermediate is interposed at a contact junction of the article and electroconductive hanger.

In preferred embodiments the intermediate slideably engages, wraps, or clamps to the hanger and may even adapt in shape or be engineered to accommodate the particular shape of a hook. In most preferred embodiments the article, via an orifice or recess, envelops at least a portion of the hook and intermediate attached thereto.

Various embodiments contemplate different conductive materials and configurations, including shape, of the intermediate. By way of materials, rubber, plastic, tape, and metalic foils all exist that are conductive and suitable, depending on the precise application. At present, most preferred is a silicone sleeve or cap having a hollow interior for receiving a hook portion of a hanger. The article to be coated then fits over or engages this enveloped portion of the hook, usually via an orifice of sufficient dimension.

Concentric "layers" of pliable sleeves are also envisioned for some coating applications wherein one sleeve is positioned over another for rapid exposure of fresh contact surfaces as appropriate. A spent layer is simply peeled away or cut off thereby exposing a fresh one. One such embodiment contemplates a tape made out of an electrically conductive material. Other embodiments contemplate a plurality of hollow tubes, one over the top of the next. These may be slit lengthwise and deposited one over the top of the next, or else constructed in multi-ply layers which are then curled to wrap or clamp to a hanger of interest. Other embodiments contemplate layers of metalic, electrically conductive foil wrapped about each hook. Of course, the diameter differential associated with this technique must accordingly be accommodated by the article.

In other embodiments, at least a portion of the hanger itself comprises a nonmetalic material such as a conductive silicone rubber or plastic. This new material can be conductively and integrally fixed during manufacture, e.g., by injection molding. Preferably, the material is pliable or bendable with the hands or other gentle means to quickly release or free unwanted deposits of coating that hinder contact and hence grounding ability. In such embodiments, the sleeve or intermediate is recyclable.

In still other embodiments, the sleeve intermediate is disposable. Of course, everything including hangers are disposable at a cost, but what distinguishes the present invention is the relatively low cost of the intermediate relative to the cost of replacing or recycling a hanger or rack. In embodiments where the intermediate is integrally a part of the hanger, the novelty resides in the hanger being easily cleaned relative to conventional hangers, e.g., metal ones, and more durable or receptive to cleanings.

In preferred embodiments, the intermediate bridges a hanger and an article to be coated. This bridge may occur in a variety of configurations as one of skill will appreciate. It may occur as described above, or else it may occur by a more comprehensive envelopment, not only of the hanger but also of the entire juncture, including a portion of the article itself. U.S. Pat. No. 5,897,709 issued to Torefors describes one such example. However, instead of a conductive bridge, Torefors specifies a non-conductive ("dielectric") cover. The present invention, by contrast, serves a dual function in further providing a conductive bridge to facilitate grounding and suitable coating, while simultaneously preserving the operative part of the hanger or hook for future use.

In most preferred embodiments, the intermediate is made of a conductive material, preferably rubber, plastic, tape, foil, or grease that can be conveniently removed, disposed of, replaced, or recycled. Most preferably the intermediate has a resistance of less than 6 megaohms, more preferably one or less megaohms, more preferably still 0.5 megaohms, and most preferably about 0.1 megaohms or less.

Preferably such intermediates are also heat resistant to temperatures up to 600° F., but most preferably resistant in ranges of between about 250° F. and 450° F.

At present, the favorite known material for the intermediate is conductive silicone, which may be fashioned by mixing different conductive and nonconductive commercially available grades in certain proportions testable by one of skill in the using routine experimentation to arrive at a final suitable product. Alternatively, fully conductive commercially available conductive silicone alone can be used that, while more expensive, still represents an improvement in the art.

The material used is conductive and can be molded to fit the myriad different sizes and shapes of hooks available, or else a universal piece may be used that fits a variety of hook shapes and sizes by pliably conforming as needed. This can occur as a slide-on sleeve, a wrap sleeve, or a clamp sleeve. Preferably, these sleeves or caps pull on and off conveniently with minor effort, but are not too loose as to permit undue amounts of coating to seep inside. Looseness is not known to otherwise disadvantage the system, provided there is some contact through which a ground may be established.

A second aspect of the invention features methods for electrostatic coating that make use of the above embodiments, either singularly or, where appropriate, combined.

Figure 1:
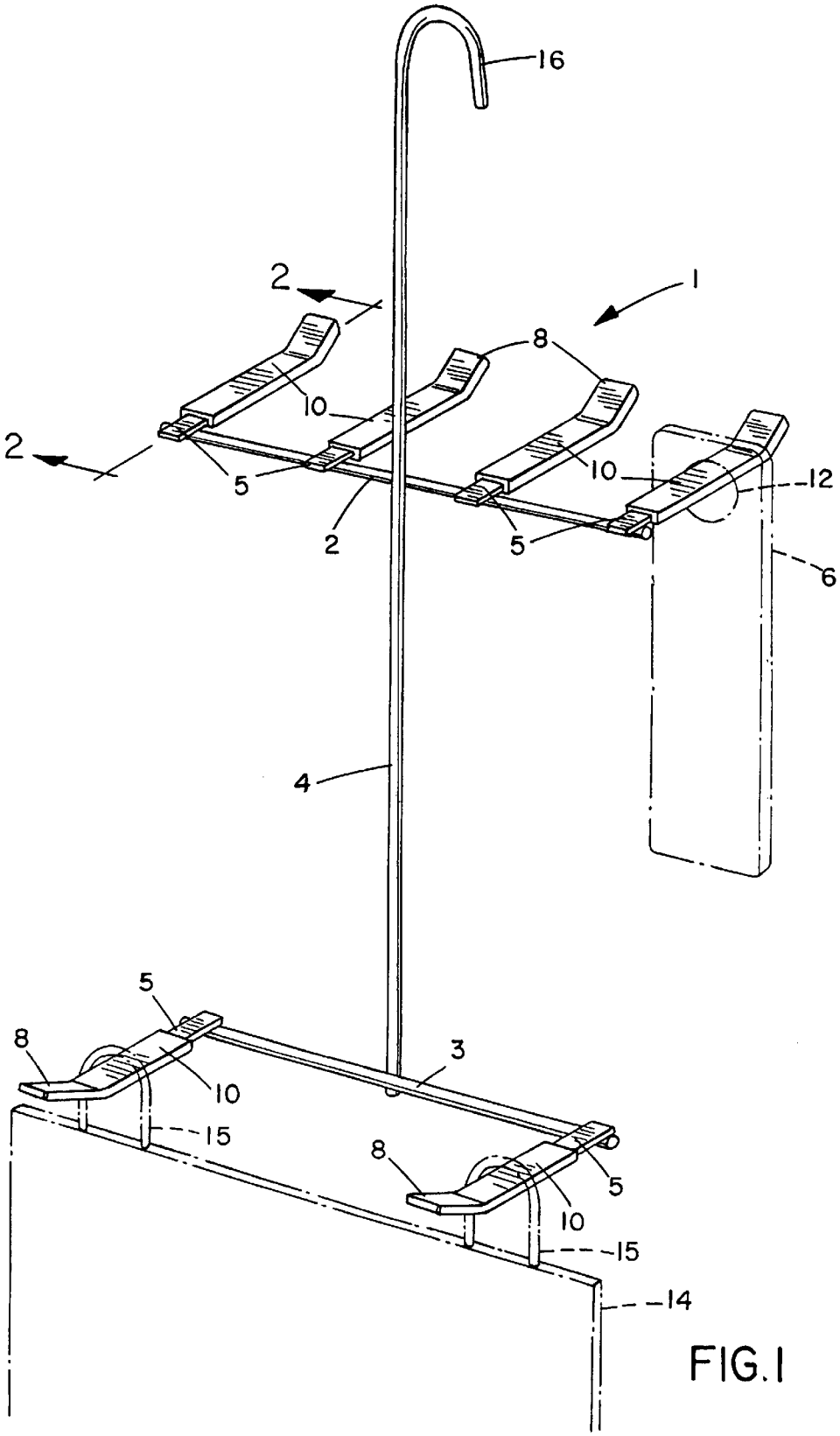
FIG. 1 is a perspective view of a rack with conductive sleeves attached.

The foregoing figures are representative of embodiments only and are not intended to be limiting of the invention. Other embodiments will be apparent to one of ordinary skill in the art. The invention will be better understood from the following detailed description, taken in conjunction with the accompanying drawings and claims.

DESCRIPTION OF THE PREFERRED EMBODIMENT

The invention makes use of novel intermediate components for use in electrostatic coating processes. The intermediate is conductive and relatively inexpensive in cost and practice, and preferably pliable, allowing for ready cleaning and/or replacement with a concomitant more efficient operation afforded to the overall system. The object is the preservation of proper grounding and the protection and preservation of more expensive implements used in the process, e.g., hangers, hooks, and racks.

As used herein, and in the claims, the following terms have the following meanings:

A "system" includes, but is not limited to, traditional apparatuses used in electrostatic coating processes.

The term "electrostatic coating" embraces any electrostatic process for adhering a coating, e.g., powder, paint, plastic or electroplating, wherein a charge differential is established to facilitate coating of an object to be coated. This includes but is not limited to the use of thermoplastics and teflon-type additions. Those of skill in the art know the broad latitude of the term, which can apply to different charging techniques and systems.

By "intermediate" refers to an object which interfaces with both a hook and an article to be coated. The shape is not to be construed as limited by the drawings or discussion herein, so long as one or more objects of the invention are otherwise met. The intermediate is designed to cover a contact portion of hook and can be hollow or capable of being made so, e.g., in the case of foil by wrapping it around a hook. In tubular embodiments, this can be a uniform, hollow piece of varying internal and external dimensions, additionally including in some embodiments one or more flanges or grips that allow easy placement and replacement, in addition to providing leverage or mechanical manipulation for, e.g., recycling. The intermediate can be a sleeve or cap, with the difference being that a sleeve has opposing free ends while a cap does not. However, both embodiments effectively provide a conductive sheath.

The terms "suitable for grounding", "grounding" and "conductive" are to be understood jointly. "Conductive" means capable of passing a charge, e.g., a stream of electrons, and can mean any substance having suitable resistance and capable of fulfilling one or more objectives of the invention. Preferably, the material should have between about 0 and 6 megaohms of resistance, more preferably less than 1 megaohm of resistance, still more preferably less than 0.5 megaohm of resistance, and most preferably having about 0.1 megaohm or lower resistance. The more preferred parameters respect, although are not limited by, National Fire Protection Agency (NFPA) standards and rationale: "To minimize the possibility of ignition by static electric sparks, powder transportation, application, recovery equipment, work pieces and all other conductive objects shall be grounded with a resistance . . . not exceeding one megaohm." NFPA Bulletin No. 33, Ch. 13, paragraph 13-4c.

"Ground" or "grounding" is a phenomenon that describes an equilibration of charge approximating that of the earth's surface. It is a reference standard by which more or less charge is gauged. For purposes of the invention, however, ground can also embrace situations where the hanger possesses a charge opposite to that of the coating material such that electrostatic bonding is achieved and promotes good transferability and coating.

The term "hanger" is not meant to be geometrically or materially limiting and may embrace a variety of structures and compositions known in the art, including but not limited to conventional metal hangers, racks, hooks, combinations of racks and hooks, and any other instrument useful in securing or supporting an article to be electrostatically coated. Of course, the piece must also be electroconductive and otherwise suitable for electrostatic coating processes.

The terms "slideably engages", "wraps", and "clamps" are each broad terms descriptive of many potential, not necessarily mutually exclusive mechanism embodiments. Besides what are shown in the instant drawings, another non-limiting example of a clamp, for instance, includes that disclosed in U.S. Pat. No. 5,897,709, herein incorporated by reference. Although the clamp described there is nonconductive, the geometry and other functions can be recruited for purposes of the instant invention.

The terms "rubber", "plastic", "tape", and "metalic foil" denote a broad range of materials that can be used in the intermediate of the invention. Preferably these materials are electroconductive and readily manipulable in shape ("pliable"), although not necessarily resilient (e.g., in the case of foil). Examples given below are illustrative and one of ordinary skill can determine other suitable materials using such widely available sources as the Handbook of Chemistry and Physics, 77th Ed. (1996–7), CRC Press, New York. The terms "rubber" and "plastic" are not necessarily mutually exclusive.

Examples of rubbers suitable for the invention include, e.g., silicone compounds as described in Example 2. Plastics that may be used include, but are not limited to, the conductive polymers polyaniline, polypyrrole, and polythiophene. All are available commericially, e.g., Aldrich Chemical Co. Milwaukee, Wis. Examples of preparation and use are discussed in Savage, *Conductive Polymers: Ease of Processing Spearheads Commercial Success, Technical Insights, Inc.,* J. Wiley & Sons, NJ (1999).

The term "integral with said hanger during manufacture" denotes either the conjoining of multiple individual components during manufacture of the hanger itself, or else embodiments where the hanger itself is made entirely of a homogeneous material, e.g., conductive silicone, which presents durability and cleaning advantages over previous compositions, systems, and methods.

The terms "disposable" and "recyclable" are meant to demonstrate alternative, not necessarily mutually exclusive, embodiments. Thus, at the discretion of the end-user a disposed of intermediate may also be suitably recycled and re-used. In other embodiments, there can be mutual exclusivity, e.g., where the sleeve, cap, etc., is engineered to fulfill its grounding and protective function only once, and then degrades, e.g., during the heating/curing step.

Other Features of the Intermediates

The conductive intermediates of the invention preferably withstand a temperature in the range of temperatures between about 200° F. and 600° F., most preferably 450° F. Conforming intermediates, preferably pliable, adapt in shape to envelop at least that portion of the hanger or rack to which the article to be coated hangs. The point of this contact may represent substantially the whole of the exterior surface area of the intermediate, or else may represent any subfraction or portion thereof.

The intermediate may assume the shape of a prophylactic sheath (cap or sleeve), e.g., tubular or hollow, that has one or more exposed hanger or rack portions flanking its point of engagement with the hanger. Also, the shape of the intermediate may appear much different in appearance when affixed to the hanger relative to when not affixed. This owes to the intermediate's pliability and/or ready ability to conform in shape to the shape of the hook or subportion thereof to which the intermediate attaches. However, as noted, in certain embodiments the fit can be engineered to be more or less precise, so that pliability is not as great a consideration.

A further aspect is that the intermediate may be readily engaged and detached with minimal effort, e.g., peeled, unwrapped, scraped, or slideably disengaged as needed, and conveniently replaced or recycled so as to economically promote proper grounding and coating efficiency. This is, at least in part, because the cost of the intermediate is typically a fraction of the cost of the other system hardware, e.g., the racks, hooks, and hangers.

The ease with which recycling and re-use (where appropriate) is accomplished depends on the physical characteristics of the intermediate. In most preferred embodiments, the intermediate is a conductive silicone having suitable thermal stability. The intermediate is ideally elastomeric or pliable, easily engaged with the hanger, e.g., by sliding over, wrapping, or impaling a surface thereof, and readily disengaged as well.

A further embodiment, as mentioned, is the layered intermediates, wherein a plurality of intermediates overlaying one another are positioned on the rack and peeled off as needed to expose fresh contact area for new objects to be coated or recoated. This layered effect may result either from tape or from layers deposited one atop another. In tubular formats, multiple tubes may be stretched substantially over one another while the bottom most tube directly contacts the hanger/hook/rack and the subsequent added layers indirectly contact it via electrical conductance across the layers. Assumed is that the means for attachment of the article to the intermediate can accommodate a range of thicknesses supplied by the additional layers, and that sufficient contact and hence conductance between the layers can be maintained.

Characteristic of preferred re-use embodiments is that by using reasonably gentle manipulation, such as rolling between the fingers, etc., the intermediate can be easily regenerated, i.e., freed of unwanted coating deposits. This is especially so for silicone sleeve embodiments, but not advised for metalic foil embodiments. In the latter case, disposal is preferred. Recycling and nonrecyling embodiments, as stated, are not necessarily mutually exclusive and may be at the discretion of the operator using the system. Such intermediate may therefore be suitable for either process.

It is also anticipated that the inherent benefits of the invention will find additional merit in automation. This will be more or less practicable depending on the specific embodiment used. At present, conductive silicone sleeves or caps for the hooks are envisioned to best perform the task. They are easily mounted via sliding, clamping, or adhering, and similarly disengageable.

In summary, prior to the invention racks and hangers in the art required frequent replacement or cleaning which entailed considerable cost and labor. Down-time associated with these processes was unacceptable and/or, in the case of recycling, exacted a heavy toll on one or more of the following factors: structure and usable life of the racks and hangers, labor allocation, environmental impact, and energy consumption. With the teachings of the invention, these concerns are overcome, simplifying the overall coating and manufacturing process. The net result is increased efficiency and profit, which may in turn be passed on to the consumer.

EXAMPLE 1

Determining Suitable Ground and Resistance

A common device used to measure continuity to ground, and which may be used to further optimize parameters and configurations suitable for the invention, is an ohm meter having a megaohm scale. This can be a volt/ohm meter (VOM) or a Megger. A VOM is adequate for checking electrical circuits, but its low voltage power source makes it less suited for checking the proper grounding of a coating system. The best device is the Megger which has a power source of 500 volts or higher. This higher voltage provides the current required to accurately measure the resistance to ground.

A preferred technique for measuring resistance is to start at the end of the process and work backward. The meter is connected between a known building ground and the uncoated part to be tested using a long test lead. This procedure is used to determine that the part is correctly ground through the entire spray booth. The amount of resistance to ground can be read on the meter, as one of skill aware.

Because the meter is attached to a known ground and to a clean part on the conveyor in the booth, all the devices in between (hanger, conveyor, swivels, etc.) are in the circuit and the resistance to proper ground can be measured. If the reading is less than one megaohm, the grounding is ideal.

If the resistance reading is greater than one megaohm, one can verify by hooking the lead to the contact point on the hanger and read it again. Then, by repeating the procedure and working back through the system (swivel or conveyor hook, conveyor) until the resistance reads in the proper range, one can determine which component of the system needs corrective action. A similar technique can be used to check for proper grounding of other objects and equipment in the coating area and system.

Of course, the resistance of the intermediate alone can also be measured thereby simplifying the task of screening for and identifying novel intermediates and materials bearing suitable characteristics for the invention.

EXAMPLE 2

Silicone Sleeve or Cap Employed

A prototype intermediate was designed and built as follows: Three quarter parts conductive silicone rubber compound (Shin-Etsu Chemical Co., Japan; part KE3611U) combined with one quarter part nonconductive silicone paste (Shin-Etsu; part KE961U) was mixed, compression molded, and cured in the form of tubing having a wall thickness of about 0.1 cm and an overall tubing diameter of about 1 cm. The resulting tubing was then cut into strips approximately 5 cm in length and the resulting sleeve intermediates slideably coaxed over and along the shafts of a plurality of metal conductive hooks. FIG. 1 is illustrative of one of but many potential working embodiments for the sleeve intermediates of the invention.

Figure 2:
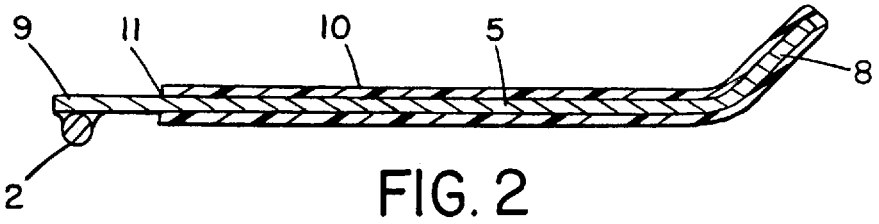
FIG. 2 is an enlarged sectional view taken on line 2—2 of FIG. 1.

FIG. 1 illustrates a rack 1 comprising a vertical post 4 with an upper cross bar 2 and a lower cross bar 3 conductively connected to the post. To said upper cross bar 2 is conductively affixed a plurality of hooks 5 for holding one or more workpieces 6. FIG. 2 depicts a sectional view of one such hook taken on line 2—2 of FIG. 1. With reference to FIG. 2, a representative hook 5 has an upwardly turned end 8 and an attached end 9 secured to the cross bar. A sleeve 10 is positioned over each hook 5 via an open end 11 of said sleeve 10, the sleeve being of conductive material. Workpiece 6 has an opening 12 to fit over the hook. Fixed to the lower portion 3 of the rack 1, is a second plurality of hooks 5 shown facing away from said first plurality of hooks 5. The second plurality of hooks may have substantially the same configuration as displayed for the individual hooks (FIG. 2), or may be different. A second type of workpiece 14 having a loop structure 15 is displayed hanging from said lower portion of the rack 1 on hooks 5. The upper end of post 4 has a grounding hook 16 for attachment to a conveyor or grounding system as commonly used and understood in the art.

Figure 3:
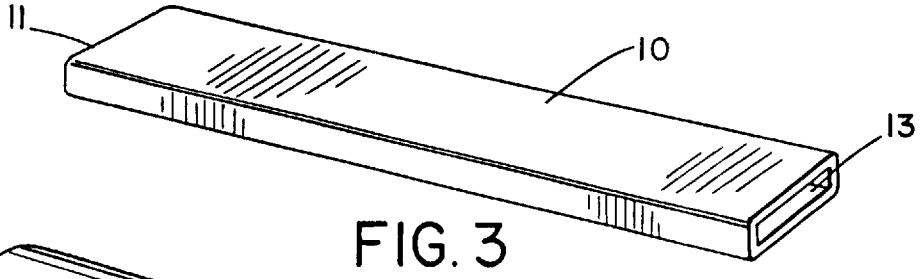
FIG. 3 is a perspective view of a sleeve with rectangular configuration.
Figure 4:
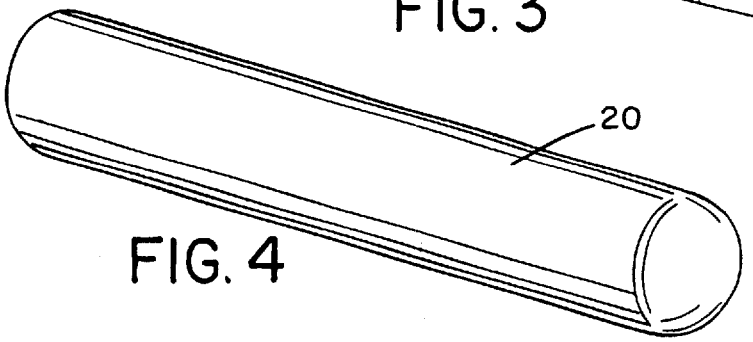
FIG. 4 is a perspective view of a cylindrical sleeve.
Figure 5:
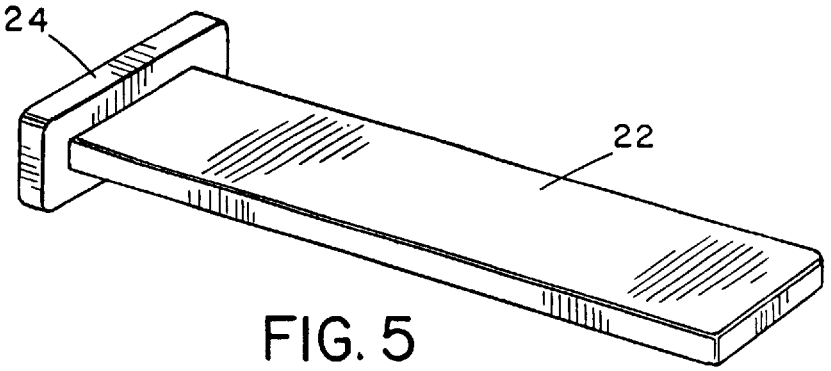
FIG. 5 is a perspective view of a sleeve with a flange for ease of fastening and removal from a hook.

Again, FIG. 1 depicts but one of many possible applications for the sleeve of the invention. The hooks in FIG. 1 may have any one or combination of intermediate sleeve configurations, e.g., those of FIGS. 3–5. With reference to FIG. 3, the sleeve may optionally have a capped or second open end 13. If open, the hook may pass to give the appearance of being impaled. This optionally open end can apply to any sleeve embodiment. In FIG. 3 the sleeve 10 is shown as a being rectangular, while sleeve 20 in FIG. 4 is cylindrical. The sleeve 22 in FIG. 5 is similar to sleeve 10 but has a flange 24 at an open end to provide a grip for applying and removing the sleeve.

The workpiece hook diameter for this prototype measured approximately 0.6 cm, although the particular dimensions are not limiting and merely illustrative of one workable embodiment. For this particular prototype, the depth of curve of said portion of the hanger measured 6 cm, and the vertical length of the hanger, not including curve, measured about 55 cm.

Coating and curing then proceed as standard in the art. Upon coating, the coated article is removed, an uncoated article added, and the process repeated. Between coatings, typically every 3–5 rounds, the sleeve/fitting is examined for coating build-up and manipulated gently to peel away or relieve unwanted coating build-up on the intermediate, thereby re-establishing a suitable ground for the electrostatic process. If desired, the recycling can take place in situ, or else can first entail removal of the rack or hanger from the conveyor. The latter is preferred so that new racks can be added as the intermediates on the old racks are serviced, thereby promoting a more continuous operation. "Used" sleeves may be replaced with unused ones, followed by a resumption of coating operations, or else the individual sleeves can be removed, gently manipulated to recycle them, and replaced.

For purposes of the intermediate prototype of Example 2, the Applicant formulated a 75:25 conductive:nonconductive silicone mixture to decrease costs. The resistance of the resulting mixture was about 1000 ohms, whereas the starting components had resistances respectively higher and lower than this. Higher ratios of conductive silicone, e.g., 76–100%, will also work and still be more economical than previously described art methods. Moreover, the Applicant further believes that lower ratios will suffice and can be determined without undue experimentation, and using routine procedures.

As one of skill in the art is aware, however, conductive silicones exist that vary in constituents. This may have a bearing on the relative success of the precise functional ratios used. Moreover, as one of skill is also aware, there can be lot-to-lot variations in silicone performance. However, as stated, one of skill may easily determine suitability using minimal, routine experimentation. Indications of some of the variations that exist and methods for preparation of the same may be found, e.g., in U.S. Pat. Nos.: 6,010,646, 6,013,201, 5,217,651, 5,164,443, 5,135,980, 5,082,596, 4,957,839, 4,898,689, 4,672,016, 4,571,371, 4,552,688, pertinent disclosures of which are herein incorporated by reference.

Besides Shin-Etsu, other current commercial vendors of conductive and nonconductive silicones include Dow Corning (Indianapolis, Ind.) and Toshiba (JP).

Improvements in silicone structures and characteristics are anticipated that will also support the invention, as will the identification of certain conductive plastics and even grease. In the event of the latter, various silicone-based greases are known that may be made conductive and suitable for the invention.

EXAMPLE 3

Flanged Sleeve Embodiment

Figure 6:
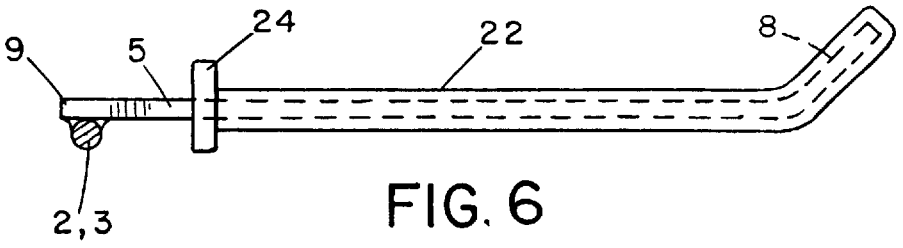
FIG. 6 is a side view of a flanged sleeve embodiment mounted on a hook.

FIGS. 5 depicts a separate embodiment wherein the sleeve or cap additionally possesses a flange or rib 24 at an open end 11 of a sleeve or cap 22. FIG. 6 demonstrates the flanged cap or sleeve 22 positioned onto a hook 5.

EXAMPLE 4

Foil Intermediates

Electrostatic coating is performed as per Example 2, except that instead of using the silicone sleeve fitting, conductive metalic foil, e.g., tin or aluminum, is substituted and wrapped around the bare or otherwise conductive hook to provide an equivalent effect.

EXAMPLE 5

Hybrid Hanger Comprising Conductive Silicone

In this embodiment, hangers are produced via compression molding that are comprised, at least in part, of conductive rubber, e.g., silicone, as described above. The silicone portion, if a minority, is preferably localized to that portion of the hanger as described for Examples 2 and 3. Thus, sleeve fittings as described above are either eliminated or else rendered redundant to the process, with the latter embodiment also anticipated to have independent advantage.

Although preferred embodiments of the invention have been described above by way of example only, it will be understood by those skilled in the field that other embodiments are also possible and that significant modifications may be made to the disclosed embodiments without departing from the scope of the invention.

I claim:

1. An electrostatic coating system, comprising:

a substantially rigid electrically conductive hanger of predetermined shape; and an elongate, electroconductive pliable intermediate sleeve having a bore extending over substantially the entire length of the sleeve and engaging over the hanger for forming a protective cover for the hanger, the sleeve being of substantially uniform shape and dimensions along at least the majority of it's length, such that the sleeve is disposed between the hanger and an article to be coated suspended from the hanger in a generally vertical orientation, and wherein the sleeve is in direct contact with both the hanger and the article, forming a conductive bridge between the article and the hanger.

2. The system of claim 1, wherein said conductive intermediate sleeve is disposable.

3. The system of claim 1, wherein said conductive intermediate sleeve is re-usable.

4. The system of claim 1, wherein said intermediate sleeve comprises a conductive material selected from the group consisting of rubber, plastic, and metallic foil.

5. The system of claim 4 wherein said conductive material comprises silicone.

6. The system of claim 5 wherein said conductive material further comprises a mixture of silicone compounds.

7. The system of claim 1 wherein said intermediate sleeve has a resistivity of less than about 1 megaohm.

8. The system of claim 1 wherein said intermediate sleeve is capable of withstanding heat between about 200° F. and 600° F.

9. The system of claim 1, wherein the sleeve forms a cover layer of substantially uniform thickness over the hanger.

10. The system of claim 1, wherein the sleeve has an external shape substantially matching the hanger shape.

11. A method of electrostatic coating, comprising the steps of:

engaging a pliable, electroconductive intermediate sleeve having a bore extending over substantially the entire length of the sleeve over a substantially rigid electrically conductive hanger, at least a portion of the hanger and the intermediate being disposed in a generally′ horizontal orientation, and the intermediate forming a cover layer of substantially uniform thickness over the hanger;

hanging an article to be treated over the hanger so that the article is suspended from the hanger and the intermediate forms a protective cover layer disposed between the hanger and the article and in direct contact with both the hanger and the article;

carrying out an electrostatic coating process on the article; and repeating the steps with other articles to be treated after recycling or replacing the intermediate to remove any unwanted deposits of the coating process accumulated on the intermediate.

12. The method of claim 11 wherein said intermediate comprises a material selected from the group consisting of rubber, plastic, and metalic foil.

13. The method of claims 12 wherein said material further comprises silicone.

14. The method of any of claims 11–13 wherein said intermediate has a resistivity of less than about 1 megaohm.

15. The method of claim 11, wherein said intermediate is capable of withstanding heat of between about 200° F. and 600° F.

16. The method of claim 12 wherein said engaging step is selected from the group consisting of slideably engaging, wrapping, or clamping said intermediate to said hanger.

* * * * *